United States Patent [19]

Toyama et al.

[11] Patent Number: 4,771,819

[45] Date of Patent: Sep. 20, 1988

[54] MANUFACTURING APPARATUS FOR SHEET METAL ACCORDING TO CONTINUOUS CASTING

[75] Inventors: Naoto Toyama; Hiroshi Yoshimura; Hidetoshi Abo; Yoshio Sawamura; Hiroshi Arai, all of Sagamihara, Japan

[73] Assignee: Nippon Metal Industry Co., Ltd., Tokyo, Japan

[21] Appl. No.: 97,412

[22] Filed: Sep. 15, 1987

Related U.S. Application Data

[63] Continuation of Ser. No. 849,230, Apr. 7, 1986, abandoned.

[30] Foreign Application Priority Data

Apr. 12, 1985 [JP] Japan ..... 60-76800

[51] Int. Cl.[4] ..... B22D 11/06

[52] U.S. Cl. ..... 164/428; 164/439; 164/337

[58] Field of Search ..... 164/479, 480, 428, 429, 164/463, 423, 439, 337

[56] References Cited

U.S. PATENT DOCUMENTS 4,274,471 6/1981 Minoura et al. ..... 164/428 X

FOREIGN PATENT DOCUMENTS

| | | | |
|---|---|---|---|
| 2063591 | 7/1971 | Fed. Rep. of Germany | 164/428 |
| 58-29552 | 2/1983 | Japan | 164/428 |
| 58-103944 | 6/1983 | Japan | 164/428 |
| 58-212844 | 12/1983 | Japan | 164/428 |
| 59-13551 | 1/1984 | Japan | 164/429 |
| 59-169653 | 9/1984 | Japan | 164/428 |

*Primary Examiner*—Kuang Y. Lin

*Attorney, Agent, or Firm*—Jordan and Hamburg

[57] ABSTRACT

Manufacturing apparatus for continuous casting of sheet metal includes a pair of chill rolls and a vessel containing molten metal. One of the rolls is of a larger diameter, on which the other roll of a smaller diameter is arranged at a position corresponding to a clock position of 12–3 O'clock. The vessel has an open forward end and is arranged to contact the larger roll or leave a gap as narrow as possible. The smaller roll is partially disposed in molten metal in the vessel. When the two rolls are driven at the same peripheral velocity in the opposite direction, molten metal is fed between the rolls to form a sheet metal which may be continuously peeled from the larger roll surface.

13 Claims, 3 Drawing Sheets

MANUFACTURING APPARATUS FOR SHEET METAL ACCORDING TO CONTINUOUS CASTING

This application is a continuation of application Ser. No. 849,230, filed Apr. 7, 1986, now abandoned.

BACKGROUND OF THE INVENTION

The invention relates generally to an apparatus for manufacturing a length of sheet metal by continuous casting, and more particularly to such apparatus having a pair of chill rolls to be driven in opposite directions, between which a molten metal is continuously supplied to directly form a length of sheet metal which may be subjected to rolling treatment as occasion demands.

The molten metal to be formed into a continuous sheet according to the invention may be any steel, steel alloy, stainless steel, various non-ferrous metals such as copper, aluminum and various alloys thereof.

The thickness of the sheet metal formed according to the invention is not critical but practically thinner than 10 mm, and preferably of a few or several millimeters. Of course it is possible to form the sheet metal even thinner.

The sheet metal may be and has actually been manufactured by feeding a molded formed ingot, billet or the like between a pair of driven rolls in a hot or cold working method, while suitably adjusting the gap therebetween. By repeating this rolling treatment while adjusting the gap to be gradually narrower or feeding between subsequently arranged pairs of rolls whose gaps are set narrower, sheet metal of a desired thickness can be obtained.

According to the continuous casting method, molten metal is poured from a tundish into a cooled mold whose bottom is open so that the formed metal of, e.g., T-shape in the transverse section thereof, is continuously drawn downwards by a pair of or pairs of pinch rolls and then cut in a desired length. When using a thin slit die or nozzle as the mold, the sheet metal can be continuously formed by casting. When using a pair of chill rolls themselves as the mold, the same purpose can be attained.

Such apparatus is disclosed for instance in Japanese Gazette Sho-56(1981)-80362 published on July 1, 1981 based on the Patent Application filed by Kawasaki Steel Corp. in Kobe, Japan on Dec. 6, 1979. Sheet metal is continuously formed by pouring molten metal from a supply nozzle into a gap having a set size between a pair of rolls arranged below the supply nozzle. The rolls are driven to revolve in different directions to each other so that the sheet metal cooled and formed thereby is continuously fed downwards. The apparatus further includes a tapered outlet guide convergent downwards just below the rolls, a nozzle for jetting air or preferably inert gas just below the outlet guide and a nozzle for jetting water just below the gas nozzle so that the still hot sheet metal is further cooled and protected from ambient air and consequently prevented from being oxidized more or less depending on the nature of the metal or alloy, by water spray which may be encouraged by the gas jet.

In the J-A No. 80362/1981, there is disclosed another embodiment, in which the molten metal is poured from the similar supply nozzle on the circumferential surface of a single roll drivingly rotated so that the sheet metal is continuously formed on the rotating roll and further cooled by the similar gas and water jet to be protected from oxidizing.

Putting the effect of preventing oxidation of the still hot sheet metal aside, the arrangement of the supply nozzle and the single roll or the pair of rolls is not satisfactory in that the molten material contained in and fed from the nozzle cannot be held unruffled which causes metallographical uneveness in the formed sheet metal and uneven thickness of the sheet. Above all, in the second embodiment, there may be caused metallographical differences between one side of the sheet metal contacted with the single chill roll and the other side cooled by ambient air.

SUMMARY OF THE INVENTION

An object of the invention is, thus, to provide an apparatus for manufacturing a length of sheet metal by continuous casting, which is capable of avoiding the defects of the related art referred to above.

This object can be attained according to the invention fundamentally by providing a pair of chill rolls to be drivingly rotated in different directions with respect to each other, one being of a larger diameter while the other is of a smaller diameter and arranged so as to urgingly contact with said larger roll at a portion of the circumferential surface of the larger roll between the apex and the 45° position deviated therefrom in either direction depending on the rotating direction, and mounting a vessel for containing a molten metal therein so as to contact the circumferential surface or leave a gap as narrow as possible therefrom for preventing the contained molten metal from leaking out therethrough, the smaller roll being dipped in the molten metal in the vessel at a lower portion so that when the two rolls are rotated in opposite directions the molten metal is supplied into a gap between the rolls to be cooled and solidified to continuously form the sheet metal which is continuously peeled from the larger roll surface.

BRIEF DESCRIPTIONS OF THE DRAWINGS

In the accompanying drawings illustrating an embodiment of the invention which is to be explained hereafter in more detail in reference thereto:

DETAILED DESCRIPTION OF THE PREFERRED EMBODIMENTS

Figure 1:
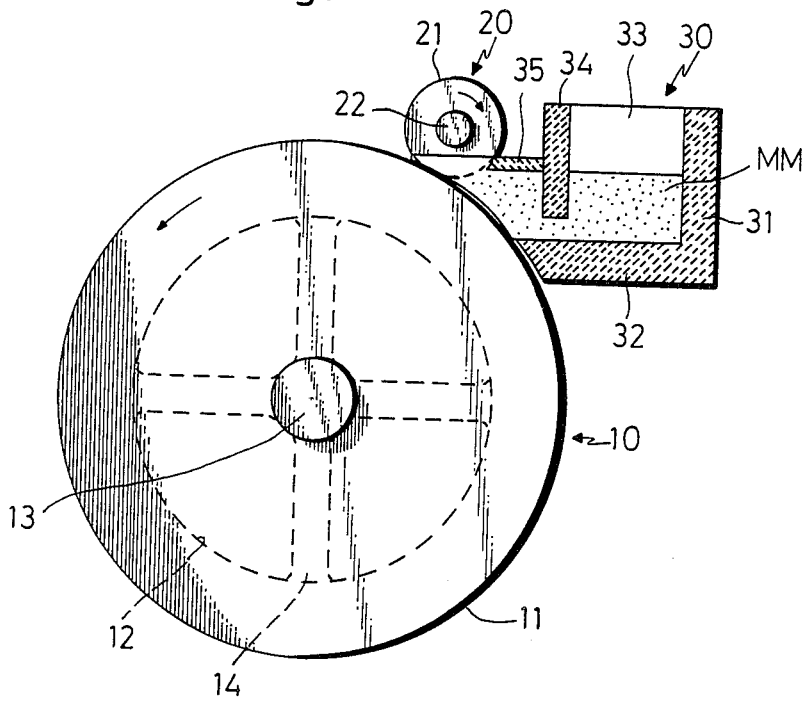
FIG. 1 is a schematic side elevation illustrating the arrangement of a larger diameter roll and a smaller diameter roll as well as a vessel for containing the molten metal which is shown in cross section for the purpose of showing the interior
Figure 2:
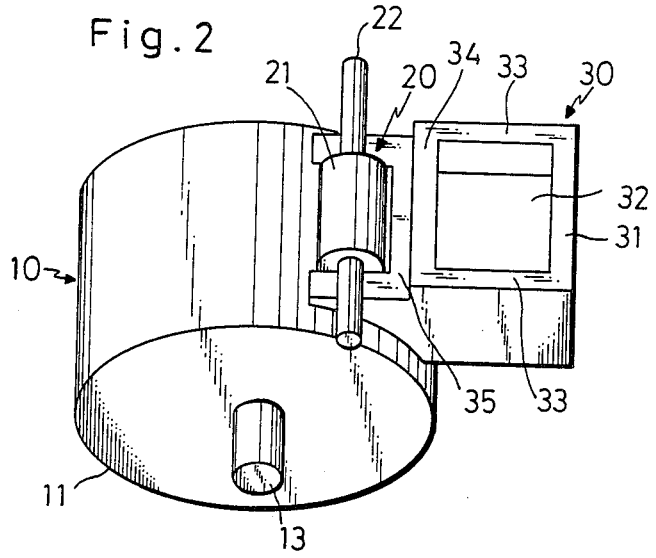
FIG. 2 is a perspective view of the apparatus shown in FIG. 1.

Now in reference to FIGS. 1 and 2, a chill roll of a larger diameter represented generally by 10 comprises a circumferential surface 11 forming an outer wall, an inner wall surface 12, an axle 13 to be driven by a prime mover not shown, a plurality of spokes 14 extending between the axle 13 and the inner surface 12, and a pair of end walls 14 which form a sealed chamber together with said outer and inner walls for circulating a cooling medium in gas or liquid state through a source thereof, the axle and spokes to be used as conduits for the coolant.

A second chill roll having a smaller diameter and represented generally by 20 comprises a circumferential surface 21 defining an outer wall, an axle 22 to be in synchronism so as to rotate at the same peripheral velocity with larger roll 10. The width or axial length of the smaller roll 20 is less than that of the larger roll 10. The smaller roll 20 may have a sealed chamber and spokes as in larger roll 20 so as to hold the circumferential surface constantly at a desired temperature, for instance 300° C., which may be considerably varied against heat conducted from the molten metal and accummulated therein. The ratio of the diameters of the larger and smaller rolls is not critical but preferably ranges from 1/10 to ½.

Smaller chill roll 20 is arranged so as to urgingly contact with larger chill roll 10 at a portion of the circumferential surface 11 between the apex or 12 o'clock position and a position deviated 45° therefrom in either direction depending on the roll revolving direction, i.e., a 1.5 o'clock position or 10.5 o'clock position. In the illustrated embodiment, the smaller roll 20 is rotated in the clockwise direction while the larger roll 10 is rotated in a different direction, namely counter-clockwise direction, and consequently the contact position lies in the range between the 12 o'clock and 1.5 o'clock positions. The illustrated position of the smaller roll 20 is deviated from the apex (0°) by about 30°.

A vessel represented generally by 30 is adapted to contain the molten metal MM to be supplied into a gap formed between the two chill rolls, which may be considered as a mold. The vessel 30 can thus be considered as a tundish and naturally must be built with a refractory material such as chromia-alumina, silicon nitride, boron nitride, fused silica, or alumina-graphite. In the embodiment, alumina-graphite is used.

The vessel 30 comprises an end wall 31, a bottom wall 32, a pair of side walls 33, a partition wall 34 and an upper wall 35. The other end of the vessel 30 opposite to end wall 31 is open so that when vessel 30 is mounted in position the concerned portion of the moving circumferential surface 11 of the rotating roll 10 may play a role as the other end wall for the vessel. For that purpose the vessel 30 must be arranged as close as possible to the circumferential surface 11 of the larger roll 10 so as to contact therewith at the free ends of the bottom wall 32 and side walls 33 or leave a gap as narrow as possible therebetween. Naturally such ends must be curved to correspond to the roll curvature. Since the smaller roll 20 is dipped in the molten metal MM contained in the vessel 30 as referred to above, the free end of the upper wall 35 also must be curved to correspond to the curvature of the smaller roll 20. The gap between the free ends of the concerned walls of the vessel and the surface of the larger roll is preferably of 0–0.5 mm. In order to avoid eventual leakage of the molten metal from the gaps, above all the gap formed between the bottom plate 32 and the circumferential surface 11, a lubricant such as pulverized chromia-alumina, boron nitride and silica nitride is preferably applied on the concerned surfaces.

The partition wall 34 is vertically extended so that the lower portion thereof is dipped in the molten metal MM for providing a gate for minimizing turbulent flow and wave motion in and on the surface of the molten metal which is poured into the vessel 30 through an open upper portion defined by the end wall 31, the partition wall 34 and side walls 32 from a ladle (not shown). The details of the vessel 30 will be explained in more detail hereafter in reference to FIGS. 4A, 4B and 4C.

Figure 3:
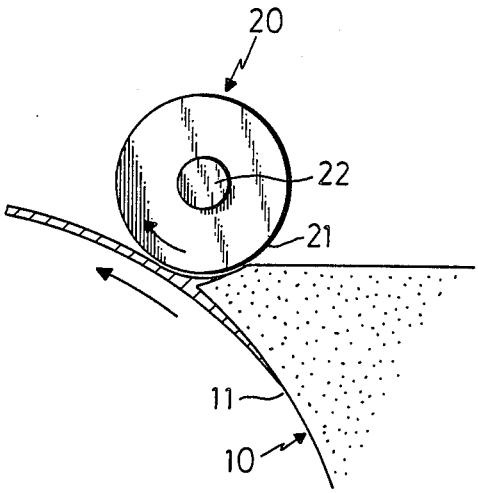
FIG. 3 is an enlarged schematic view of a part of the larger roll, the smaller roll and a part of the molten material illustrating how the molten material is formed into sheet metal.

Now in reference to FIG. 3, the smaller roll 20 adapted to be urged toward larger roll 10 is retracted a little when operation is commenced so as to make a desired gap between the circumferential surfaces of the rolls. When driving the chill rolls to rotate in the respective directions shown by arrows, the molten metal is forcedly supplied into the gap so that the metal is cooled and solidified to form a sheet metal. Then the smaller chill roll 20 is urged towards the larger chill roll 10 so as to attain a desired thickness of the sheet metal. The leading edge of the sheet metal is continuously drawn to be peeled from the circumferential wall 21. It may be suitably cut in a desired length or coiled as needed. The molten metal MM must be kept at a desired level. It goes without saying that when driving the rolls to revolve faster the productivity of the sheet metal is increased, but there is naturally an upper limit on the rotating speed to be readily appreciated by glancing at FIG. 3.

Figure 4A:
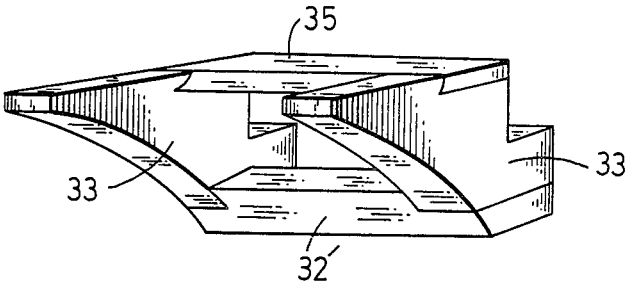
FIGS. 4A, 4B and 4C are respectively, a perspective view, a side section and a front view partly in section of the vessel for containing the molten metal illustrating details thereof.
Figure 4B:
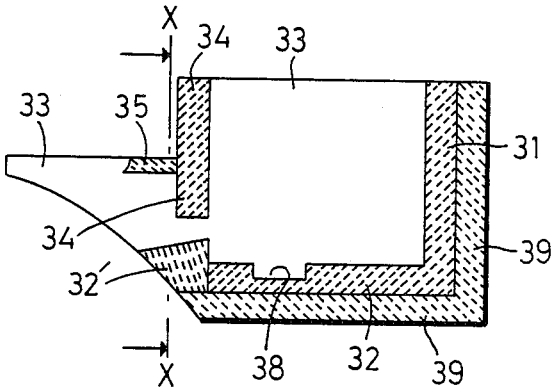
Figure 4C:
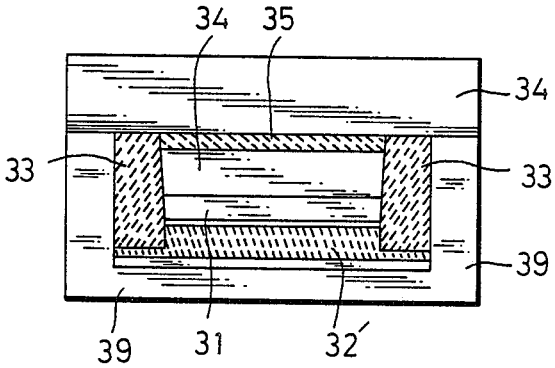

Now in reference to FIG. 4A which is a perspective view of a forward portion of the vessel 30, FIG. 4B showing a side section of the vessel consisting of the forward portion and the body portion which is surrounded by a thermally insulating material 39, and FIG. 4C showing a front elevation of the above partly in section taken along a line X—X in FIG. 4B, a separate bottom wall member 32' is used for ease in forming the curved end face, which may be disengaged from a pair of side walls 33, which may in turn be disengaged from the upper wall 35 for the purpose of repair.

As best shown in FIGS. 4A and 4B, the free end surfaces of the side walls 32 and separate bottom wall portion 32' are curved so as to correspond to the curvature of the larger roll 10, and the free end surface of the upper wall 35 is curved so as to correspond to the curvature of the smaller roll 20 as referred to above.

As seen in FIG. 4B, there is provided a recess 38 formed in the bottom wall 32 in order to prevent turbulent flow and wave movement inevitably caused when pouring molten metal from the ladle, in addition to the gate 34. As occasion demands a plurality of recesses and gates may be provided.

As seen from FIG. 4C, the inner surface of each side wall 33 is preferably curved so that the distance between the opposite side walls 33 is made larger toward the top in order that partly solidified molten metal will not damage the wall.

An example using the vessel and rolls illustrated above will now be described. The vessel was made of alumina-graphite and covered with conventional firebricks of 65 mm thickness. The distance between the opposite side walls were 305 mm at the bottom and 315 mm at the top. The assembly of the forward portion of the vessel was sufficiently heated in advance in order to prevent thermal expansion thereof during the operation and applied with a coating of lubricant at the free end surfaces of the concerned walls. About 300 kg of molten steel SUS 304 was poured in the vessel and the prevailing temperature was kept at a temperature above the melting point by about 50°–75° C.

A smaller roll of 200 mm diameter and 315 mm width was arranged in the position as shown in FIG. 1 relative to a larger roll of 1000 mm diameter and 560 mm width, and urged thereagainst by 1000 kg. The rolls were driven to rotate at a peripheral velocity of 20 m/min. The arc length of the roll contacting the molten steel was 200 mm.

A sheet steel of 2.2 mm uniform thickness and 315 mm width was obtained. The sheet was of well uniformly dispersed fine dendrite structure. The tensile strength was 60.2 kg/mm$^2$, the elongation 49.7% and the hardness Hv 156.

After acid washing, the sheet steel was rolled by cold working to about 50% reduction followed by annealing. The microstructure was very satisfactory in comparison with marketed sheet steel formed according to conventional continuous casting.

Figure 5:
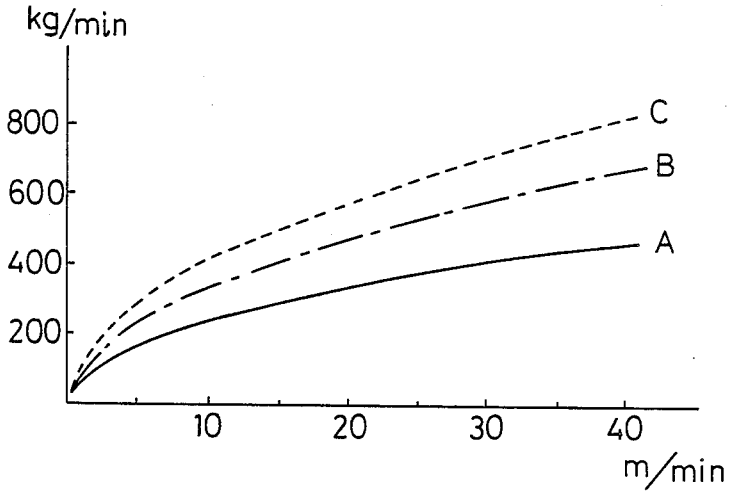
FIG. 5 is a diagram showing the relation of the peripheral velocity of the rolls (m/min.) with the productivity of the sheet metal (kg/min) to be formed according to the invention.

In reference to FIG. 5 showing the relation of the productivity of the sheet metal with the roll peripheral velocity and the arc length of the roll contacting the molten metal, according to the invention, cooling can be made successively over the wider area so that the productivity of the sheet metal is considerably improved. The thickness d (mm) of the sheet metal$=2.8\times t$ in which t (sec) means a time during which the roll contacts the molten metal. This time naturally depends on arc length.

The curve A shown in a solid line was attained by the example referred to above where the arc length was 200 mm. The curves B and C are for the cases where the arc length is respectively 400 mm and 600 mm. Curve A has already been attained by setting the peripheral velocity in the range of 20–40 m/min according to the invention. There are various problems in order to make the arc length longer and the peripheral velocity faster to be readily understood by those skilled in the art, which are the new technical problems to be dissolved.

What is claimed is:

1. An apparatus for continuous casting of a length of sheet metal comprising:

a first horizontally-arranged chill roll having a horizontal axis, a circumferential surface, a first diameter, and a first longitudinal length;

a second horizontally-arranged chill roll having a horizontal axis parallel to the horizontal axis of the first chill roll, a circumferential surface, a second diameter smaller than said first diameter of said first chill roll and a second longitudinal length shorter than said first longitudinal length of said first chill roll;

drive means for rotationally and controllably driving said first chill roll in one direction and said second chill roll in an opposite direction to said first chill roll in synchronism with said first chill roll;

said first chill roll being spaced from said second chill roll to form a gap therebetween, said first chill roll having an uppermost point on said first circumferential surface, said second chill roll being positioned relative to said first chill roll such that said gap is disposed at said circumferential surface of said first chill roll between said uppermost point and forty-five degrees from said uppermost point along said circumferential surface of said first chill roll;

means for controllably urging said second chill roll towards and away from said first chill roll to adjust the pressure and gap therebetween to attain a desired thickness of sheet metal passing between said first and second chill rolls; and a vessel for containing molten metal therein and supplying molten metal to said first and second chill rolls, said vessel comprising a bottom wall means and two upright side walls extending from said bottom wall means, said upright side walls being spaced from one another a distance substantially equal to said second length of said second chill roll, said second chill roll being at least partially disposed between said two upright side walls, said bottom wall means and each of said side walls having a free end positioned adjacent to said circumferential surface of said first chill roll to prevent leakage of molten metal between said bottom wall means and said first chill roll and between said side walls and said first chill roll, said vessel also comprising an upper wall means extending between said two side walls and having a free end positioned adjacent to said circumferential surface of said second chill roll to prevent leakage of molten metal between said upper wall means and said second chill roll, whereby said first and second chill rolls are rotated cooperatively in opposite directions to draw molten metal from said vessel into said gap between said first and second chill rolls to form sheet metal therefrom, said first and second chill rolls delivering the formed sheet metal upwardly from said gap and onto the circumferential surface of said first chill roll.

2. An apparatus according to claim 1, wherein said upper wall means comprises an upper wall part and a partition wall part, said upper wall part and said partition wall part each extending between said two upright side walls, said partition wall part being vertically disposed, said upper wall part being horizontally disposed, said upper wall part having one end joined to said partition wall part, said upper wall part having another end positioned adjacent to said circumferential surface of said second chill roll to prevent leakage of molten metal between said upper wall part and said second chill roll.

3. An apparatus according to claim 2, wherein said partition wall part has a lower end spaced from said bottom wall means to define a gate space between said lower end of said partition wall part and said bottom wall means, said partition wall part and said gate space dividing said vessel into a first and a second section such that the molten metal passes from said first section to said second section through said gate space.

4. An apparatus according to claim 3, wherein said gate space opens up to an enclosure defined by said upper wall part, a portion of said partition wall part, a portion of said bottom wall means, a portion of said circumferential surface of said first chill roll, and a portion of said circumferential surface of said second chill roll, said enclosure opening up to said gap between said first and second chill rolls.

5. An apparatus according to claim 1, wherein said bottom wall means comprises a bottom wall part joined to said side walls and a separate bottom wall member disposed on said bottom wall part, said bottom wall member having a curved end face adjacent said circumferential surface of said first chill roll.

6. An apparatus according to claim 1 further comprising recess means in said bottom wall means to prevent turbulent flow and wave movement of molten metal in said vessel.

7. An apparatus according to claim 1, wherein said side walls have an upper end and a lower end, said upper ends of said side walls being spaced from one another a greater distance than the spacing between said lower portions of said side walls.

8. An apparatus according to claim 1 further comprising a pulverized ceramic material coating on said free ends.

9. An apparatus according to claim 1, wherein the diameters of said first and second chill rolls have a ratio ranging from 1 to 10 and 1 to 2.

10. An apparatus for continuous casting of a length of sheet metal comprising:

a first horizontally-arranged chill roll having a horizontal axis, a circumferential surface, a first diameter, and a first longitudinal length;

a second horizontally-arranged chill roll having a horizontal axis parallel to the horizontal axis of the first chill roll, a circumferential surface, a second diameter smaller than said first diameter of said first chill roll and a second longitudinal length shorter than said first longitudinal length of said first chill roll;

drive means for rotationally and controllably driving said first chill roll in one direction and said second chill roll in an opposite direction to said first chill roll in synchronism with said first chill roll;

said first chill roll being spaced from said second chill roll to form a gap therebetween, said first chill roll having an uppermost point on said first circumferential surface, said second chill roll being positioned relative to said first chill roll such that said gap is disposed at said circumferential surface of said first chill roll between said uppermost point and forty-five degrees from said uppermost point along said circumferential surface of said first chill roll;

means for controllably urging said second chill roll towards and away from said first chill roll to adjust the pressure and gap therebetween to attain a desired thickness of sheet metal passing between said first and second chill rolls;

a vessel for containing molten metal therein and supplying molten metal to said first and second chill rolls, said vessel being mounted adjacent said first and second chill rolls to prevent molten metal from leaking out from between said vessel, said first chill roll, and second chill roll, whereby the first and second chill rolls are rotated cooperatively in opposite directions to draw molten metal from said vessel and into said gap between said first and second chill rolls to form sheet metal therefrom, said first and second chill rolls delivering the formed sheet metal upwardly from said gap and onto the circumferential surface of said first chill roll;

said vessel comprising a bottom wall means and two upright side walls extending from said bottom wall means, said upright side walls being spaced from one another a distance substantially equal to said second longitudinal length of said second chill roll, said second chill roll being at least partially disposed between said two side walls, said bottom wall means and each of said side walls having a free end adjacent to said circumferential surface of said first chill roll, said vessel also comprising an upright partition wall extending between said two side walls and spaced from said second chill roll, said vessel further comprising an upper wall extending from said partition wall, said upper wall having a free end adjacent to said circumferential surface of said second chill roll.

11. An apparatus according to claim 10, wherein said partition wall is a generally vertical wall and said upper wall is a generally horizontal wall, said partition wall having a lower free end which is spaced from said bottom wall, said partition wall having an upper end, said upper wall being connected to said partition wall at a position on said partition wall intermediate said upper end and said lower free end of said partition wall, said vessel means further comprising an upright end wall connected to said bottom wall means and to said two side walls, said end wall being spaced from said partition wall.

12. An apparatus according to claim 10, wherein said upper wall is disposed at a position lower than said horizontal axis of said second chill roll.

13. An apparatus according to claim 10, wherein the longitudinal length of the circumferential surface of said first chill roll is greater than the distance between said two side walls.

* * * * *